United States Patent [19]

Glucksman et al.

[11] 4,230,933

[45] Oct. 28, 1980

[54] ELECTRIC AIR HEATING ELEMENT

[75] Inventors: Dov Z. Glucksman, 43 Norwood Ave., Newton, Mass. 02159; Karl H. Weidemann, Brookline, Mass.

[73] Assignee: Dov Z. Glucksman, Newton, Mass.

[21] Appl. No.: 878,945

[22] Filed: Feb. 17, 1978

[51] Int. Cl.[3] ..... H05B 3/02

[52] U.S. Cl. ..... 219/375; 338/218; 338/282; 338/302; 338/321

[58] Field of Search ..... 338/57, 58, 217, 218, 338/252, 267, 270, 278, 282–283, 296, 297, 298, 299, 301–305, 317, 319, 321; 219/368–370, 373–375, 551, 550, 532; 34/96–98, 245 R

[56] References Cited

U.S. PATENT DOCUMENTS

| | | | |
|---|---|---|---|
| 1,490,089 | 4/1924 | Bridges | 338/296 |
| 1,733,023 | 10/1929 | Kremenezky | 338/301 |
| 1,840,168 | 1/1932 | Mucher | 338/321 |
| 2,298,315 | 10/1942 | Siegel et al. | 338/296 |
| 2,502,044 | 3/1950 | Isaacson | 338/282 |
| 3,304,625 | 2/1967 | Gesmar et al. | 34/99 |
| 3,391,372 | 7/1968 | McLean | 338/321 |

FOREIGN PATENT DOCUMENTS

| | | | |
|---|---|---|---|
| 2015628 | 10/1971 | Fed. Rep. of Germany | 219/374 |
| 2608510 | 9/1977 | Fed. Rep. of Germany | 219/375 |
| 2618819 | 11/1977 | Fed. Rep. of Germany | 219/375 |
| 2619097 | 11/1977 | Fed. Rep. of Germany | 219/375 |
| 166278 | 5/1926 | France | 338/218 |

*Primary Examiner*—Elliot A. Goldberg
*Assistant Examiner*—Bernard Roskoski
*Attorney, Agent, or Firm*—John S. Roberts, Jr.

[57] ABSTRACT

An electric air heating element is designed for positioning in the cylindrical or conical outlet tube of a hair dryer. It consists of a star-shaped coil carrier in the shape of four fins extending radially from a common center line in the axis of the outlet tube towards the tube walls. The fin edges are serrated by adjacent rectangular slots, the slots on each edge penetrating alternately to a shallow and to a greater depth, and a ribbon-shaped resister laid into these slots is helically wound around the coil carrier. In this way successive windings lie in different planes and air turbulence around the heating coil is thereby increased, improving the heat transfer between the resistor windings and the throughflowing air.

6 Claims, 3 Drawing Figures

ELECTRIC AIR HEATING ELEMENT

BACKGROUND OF THE INVENTION

The invention relates to an electric heating element, particularly to an element suitable for hair dryers.

Heating elements for hair dryers should be as short as possible in order to reduce the weight of the appliance and to make it easy to handle; on the other hand it should present an adequate heat transfer surface while offering a minimum of flow resistance, with a view to permit the provision of a small fan and fan motor in the dryer. In the past I have found that the most suitable heating element answering the above requirements is in the shape of a ribbon-shaped resistor helically wound on a spider-shaped core, in such a manner that the ribbon surfaces of all windings are parallel to the air flow. This design ensures a minimum of flow resistance, since the front surface offered to the air flow by the thin resistor is very small compared with the total heat exchange area. A high heat exchange coefficient is attained by the air spaces between adjoining coil windings, because they interrupt the boundary layer apt to form along a plain continuous surfaces, and thus create air turbulence.

Although this type of heater coil gives very good results, I have now discovered that I can still improve the heat transfer by staggering successive windings and thus obtain a shorter total length of the element by providing less windings which, however, dissipate the same heat energy through a smaller exchange surface by virtue of increased turbulence.

SUMMARY OF THE INVENTION

The heating element which adapted to be positioned in a cylindrical of conical duct of a hair dryer or other apparatus delivering hot air, comprises a solid star-shaped coil-carrier of a non-conductive and heat-resistant material, in the shape of at least four longitudinal fins extending in radial direction from a common jointing line. The outer edges of all fins are serrated by substantially equidistant rectangular slots of different depth as measured from said outer edge of each fin, and a ribbon-shaped resistor is wound helically around said coil carrier to form a coil. The windings are laid in successive rectangular slots with the ribbon surface substantially parallel to the outer fin edge and to the air flow. The resulting coil thus comprises at least two parallel surfaces of resistor windings which, in the case of four fins, form at least two coaxial square cylinders or cylinder frustums. In a preferred embodiment of the heating element each fin edge is serrated by alternate slots of shallow depth and of greater depth respectively, thus forming two parallel layers of resistor windings.

In order to provide a larger distance between the coil and the duct walls both end portions of each fin are radially extended to a greater length than its serrated edge, which end portions serve to firmly secure the heating element in the duct or outlet of the air heating apparatus.

With a view to shorten the apparatus the center portion at one end of the coil carrier may be recessed to permit placing therein an electric fan motor, the resistor coil surrounding the motor at this end.

The ribs may be perforated in order to reduce the weight of the element and to increase the air turbulence.

SHORT DESCRIPTION OF THE DRAWINGS

FIG. 1 is an isometric view of a coil carrier, partly wound, suitable for a cylindrical duct, FIG. 2 is an isometric view of a coil carrier provided with slots of three different depth dimensions, partly wound and suitable for a conical duct, and FIG. 3 is a side view of a heating element assembly, incorporating the coil carrier illustrated in FIG. 1.

DESCRIPTION OF THE PREFERRED EMBODIMENT

Figure 1:
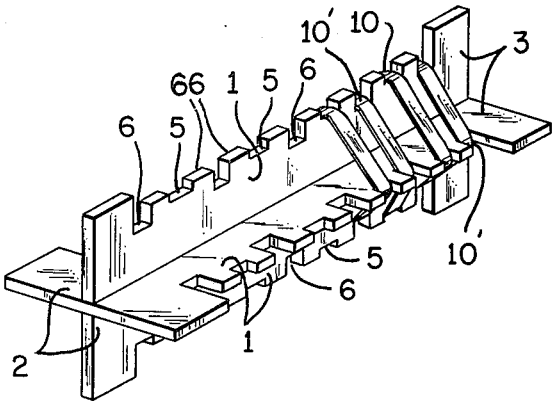

The coil carrier illustrated in FIG. 1 comprises four rectangular fins 1 of similar width and length joined at right angles along their inner edges on a common center line. The respective end portions, 2 and 3, of the fins extend to the largest distance from the common center and serve to locate the element in a cylindrical air discharge duct D, FIG. 3, while the central edge portion between these ends, is slightly recessed. This portion of each fin is provided with a plurality of inwardly extending rectangular slots or notches 5 and 6, slots 5 being a shallow depth, while the slots 6 are deeper, as measured from the edge, i.e. the bottom of the slots 6 is nearer the carrier center than that of the slots 5. The slots are of equal width and equidistantly spaced by a common module denoted at 66, FIGS. 1 and 2, however staggered by one quarter module in respect of every two fins positioned at a right angle, in one sense of angular progress, for the purpose of providing a helical path for the resistor ribbon. Four windings, 10 and 10', of a ribbon-shaped resistor are shown to be wound around the coil carrier, alternately laid in shallow and deep slots. The resistor is slightly narrower than the slots 5 and 6, and it can be readily discerned that the windings 10 laid in the shallow slots are of greater length than those (10') in the deeper slots, thus alternate windings in the shape of larger and smaller squares are being formed, corresponding sides of all larger squares lying in common planes, and similarly the sides of all smaller squares. It is understood that only a few windings have been such shown in order to present a clear picture of the slots. It is further understood that for clearness sake the size of the slots and the module are shown larger in proportion to the total dimensions of the coil carrier than in an actual embodiment, which would have a much larger number of windings.

Figure 3:
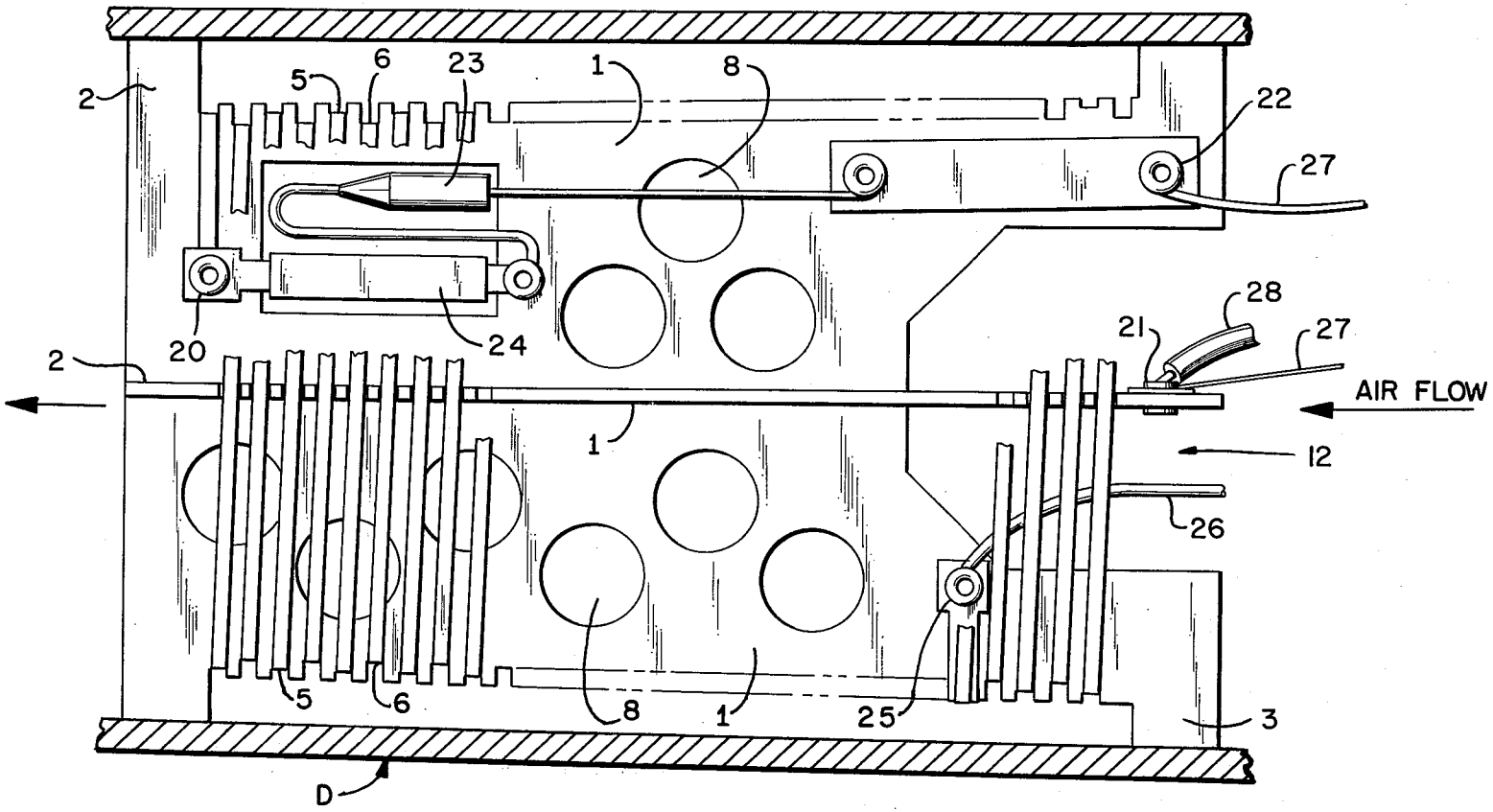

A complete heating element is shown in FIG. 3. Herein a coil carrier comprises four fins 1 which are jointed at common center, all fins being of equal length and width, their end portions 2 and 3 being higher than the slotted center portion. The fins are perforated by a number of round holes 8 which serve to create greater flow turbulence, besides somewhat reducing the weight of the unit. Each fin edge is serrated along its recessed center portion by alternating shallower and deeper, rectangular slots 5 and 6 respectively. A heating coil is formed from a ribbon-shaped resistor laid successively into the slots 5 and 6 and wound around the coil carrier beginning from a L.H. terminal 20 to a R.H. terminal 21. The right hand end of the coil carrier is recessed (12) in its center corresponding to the shape of a fan motor to be positioned in this recess when assembling a hair dryer or another air heating apparatus.

The coil terminal 20 is connected to a switch (not shown) by a cord 27 via a terminal 22 and through a fuse 23 and a thermistatic switch 24, while a second cord wire 28 is attached to the second coil terminal 21.

In order to reduce the motor voltage a portion of the coil is placed in the motor circuit in series with the motor, by means of an intermediate terminal or weld-top 25, the motor leads 26 and 27 issuing from the terminal 25 and the right hand terminal 21, respectively.

Figure 2:
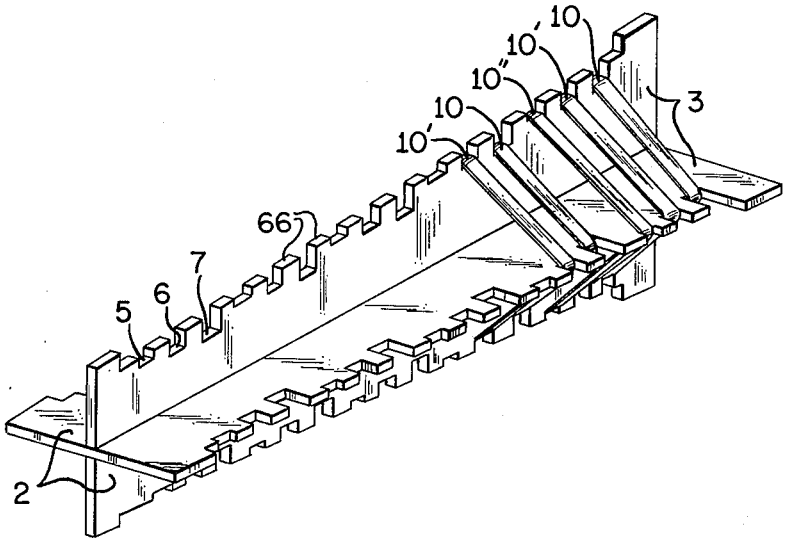

FIG. 2 illustrated a coil carrier similar to that shown in FIG. 1 however it differs from the latter in that it has slots of three different depth dimensions, i.e. shallower slots 5, slots of medium depth (6) and of larger depth (7). It further differs from the former embodiment in that the coil carrier is in the shape of a pyramidal frustum, permitting its positioning in a conical duct, the remaining parts of the two carriers being identical. A ribbon-shaped resistor is wound around the coil carrier, its windings (10, 10' and 10'') lying in three parallel planes.

The main advantage of the present type of heating element lies in the fact that heat transfer is increased by preventing any boundary layer from being formed on a continuous plane, since the large air spaces between adjoining windings break up this formation and cause a turbulent air flow. On the other hand the narrow front side of the ribbon exposed to the air flow presents very small flow resistance, thus permitting a small fan and fan motor to be installed in the appliance.

Although only two embodiments of the air heating element have been described hereinbefore, it is understood that the invention may undergo various alterations and modifications to be carried out by a person skilled in the art, within the spirit of the invention and the scope of the appended claims.

It is, for instance proposed to provide any number of fins from a minimum of three to eight or more, the latter being suitable for a duct of large diameter as in industrial applications.

The coil carrier having four fins is advantageous because it is readily assembled from two plates each corresponding in width to the width of two opposite fins; these plates are slotted along their center for half their length and nested by pushing them lengthwise together in cross fashion, in a manner known per se.

In certain cases more than three types of slots may be provided, especially in the case of large diameters and great lengths of the elements.

What I claim is:

1. In combination, a tubular air discharge unit and heating element for a hair dryer, said element being positioned in said tubular air discharge duct in coaxial alignment therewith, said heating element comprising a solid coil-carrier of non-conductive and heat resistant material and including at least four longitudinal fins extending radially outwards from a common center line coinciding with the axis of such an air duct, said fins being of equal thickness and having the major extent of their outer edges serrated by inwardly extending substantially rectangularly shaped sets of notches of at least two different depths, said notches being equally spaced by a common spacing module and adjacent sets of notches having a different common depth so as to be intermittently higher and lower throughout such major extent of such outer edges, said notches being axially staggered by a quarter spacing module in respect of every two fins lying at right angles to one another to provide a helical path for resistor element, and a coil in the shape of a flat ribbon resistor wound helically around said coil carrier with the windings being laid successively in said notches with the ribbon lying in the bottom of the notches and extending parallel to the outer edges of the fins to provide intermittent layers in different parallel planes to provide high heat transfer with low flow resistance and to increase air turbulence around the said coil to facilitate breaking up the air boundary layer and providing at least one crossover of the ribbon.

2. An electric air heating element as defined in claim 1 wherein the fins are perforated by throughgoing holes to increase air turbulence.

3. An electric air heating element as defined in claim 1 wherein one end of the coil carrier is recessed in its center portion for the purpose of accomodating therein a portion or the whole of an electric fan motor.

4. An electric air heating element as defined in claim 1 wherein each outer fin edge is serrated by notches of three different depth dimensions.

5. An electric air heating element as defined in claim 1 including a multitude of weld-tops to create additional circuits.

6. An electric air heating element as defined in claim 5 where at least two weld-tops create an additional circuit.

* * * * *